United States Patent [19]

Adachi

[11] Patent Number: 4,986,740

[45] Date of Patent: Jan. 22, 1991

[54] MECHANICAL SUPERCHARGER HAVING A THRUST BEARING

[75] Inventor: Kazunari Adachi, Toyoake City, Japan

[73] Assignee: Alsin Seiki Kabushiki Kaisha, Kariya City, Japan

[21] Appl. No.: 401,647

[22] Filed: Aug. 31, 1989

[30] Foreign Application Priority Data

Sep. 27, 1988 [JP] Japan ..... 63-241547
Sep. 27, 1988 [JP] Japan ..... 63-241548

[51] Int. Cl.[5] ..... F04C 29/06

[52] U.S. Cl. ..... 418/83; 384/107; 384/112; 418/88; 418/206

[58] Field of Search ..... 418/88, 94, 83, 98, 418/206; 384/107, 112, 121, 123, 425

[56] References Cited

U.S. PATENT DOCUMENTS 1,834,976 12/1931 Schmidt ..... 418/94 X
2,726,604 12/1955 Aspelin et al. ..... 418/88 X
2,764,945 10/1956 Heep ..... 418/88 X
2,961,151 11/1960 Fobian ..... 418/88 X
2,975,964 3/1961 Osterkamp ..... 418/88
3,088,660 5/1963 Voggenthaler ..... 418/88
4,497,618 2/1985 Anderson et al. ..... 418/88 X
4,836,692 6/1989 Hagen ..... 384/107
4,878,820 11/1989 Doi et al. ..... 418/203

*Primary Examiner*—Michael Koczo
*Attorney, Agent, or Firm*—Oblon, Spivak, McClelland, Maier & Neustadt

[57] ABSTRACT

In a mechanical supercharger having rotors mounted on rotor shafts, the rotor shafts are rotationally and axially supported in the supercharger housing by first and second sliding bearings. The first sliding bearing includes an inner part fixed to each of the rotor shafts and having both a cylindrical part and a radially extending, disc-like plate part. The first bearing also includes an outer part having bores closely surrounding the cylindrical parts of the inner part and axial surface facing an axial surface of the plate parts of the inner parts. A retainer engages the outer part and encloses another axial face of the inner part to form bearing spaces into which oil can be pumped for lubricating the sliding bearing. The pump can be in the form of spiral grooves in the radially extending, disc-like plate part.

10 Claims, 4 Drawing Sheets

MECHANICAL SUPERCHARGER HAVING A THRUST BEARING

BACKGROUND OF THE INVENTION

1. Field of the Invention

The invention concerns a mechanical supercharger for an internal combustion engine and having a sliding bearing mechanism.

2. Description of Related Art

A conventional mechanical supercharger is shown in Japanese Patent Laid-open No. 62-199928. This conventional mechanical supercharger is shown in FIG. 5. Therein, reference numeral 220 indicates a rotor which is fixed to a rotor shaft 221 by a fastening pin 222, and the both ends of the shaft are rotationally supported in a housing 224 via sliding bearing 223. The housing 224 includes a rotor-housing 225*a*, a bearing-housing 225*b* which supports the sliding bearings 223, and two side-housings 226*a*, 226*b* which are respectively fixed to the rotor-housing 225*a* and the bearing-housing 225*b*.

Two of the rotors 220 are positioned in the volume which is formed by the rotor-housing 225*a* and a bearing-housing 225*b*, and a bypass passage for the intake air opens in the rotor-housing 225*a*. The lower shaft 221 shown in FIG. 5 is a driven shaft of the mechanical supercharger, and extends through the rotor-housing 225*a* so as to project into the side-housing 226*a*.

Within the side-housing 226*a* is a wet type multiple plate clutch 230 which may be conventional and which transmits the rotation of a pulley 228 to the shaft 221. A shaft 229 of the pulley 228 is driven by a direct driving system of the internal combustion engine. The pulley 228 and the shaft 229 are rotationally supported in the side-housing 226*a* by ball bearing 233, together with a supporting plate 232 supporting multiple plates 231 of the driving side of the multiple plate clutch 230. To the shaft 221 is fixed a supporting plate 236 supporting multiple plates 235 of the driven side of the multiple plate clutch 230, and the multiple plates 235 are disposed between the multiple plates 231 of the driving side. The multiple plates 231, 235 rotate together with their respective supporting plates 232, 236 and are able to move axially thereon. The multiple plates 231, 235 are pressed into engagement for coupling the shafts 221 and 229 by the magnetic force resulting from excitation of coil 237 fixed to the side-housing 226*a*, and the force of this engagement is controlled by the amount of the excitation current supplied to the coil 237. Namely, the torque transmitted from the shaft 229 to the shaft 221 is controlled by the amount of excitation current supplied to the coil 237.

Oil is supplied between the multiple plates 231, 235 from a sump 238. The multiple plate clutch 230 has the property of permitting sliding between the multiple plates 231, 235 for small values of the current to the magnet 237. The oil operates as a lubricant and coolant and is stored in the sump 238 at the bottom of the side-housing 226*a*, and the lower parts of the supporting plates 232, 236 and multiple plates 231, 235 are submerged in the oil. Therefore the oil always exists between the multiple plates 231, 235.

An oil receiver 240 above the sliding-bearing 223 in FIG. 5 and a oil passage 241 from the oil receiver 240 to the sliding-bearings 223 are formed in the rotor-housing 225*a* so as to supply the oil to the sliding bearings 223 as a lubricant. The oil is supplied to the oil receiver by flying; that is, when the supporting plates 232, 236 rotate, the oil around the supporting plates 232, 236 is flung upward by centrifugal force and flows into the oil receiver 240. The oil supplied to the sliding-bearings 223 is also used for the lubrication of oil seals 242 fit to the outer faces of the shafts 221. The oil returns to the side-housing 226*a* through the passage 241*c*.

A pair of the shafts 221 project into the side-housing 226*b* as shown of the right side in FIG. 5, and meshing gears 245 are fixed to the ends of the shafts 221, as a result of which the two rotors 221 rotate simultaneously. In the bottom of the side-housing 226*b* is an oil sump 238' similar to that in the side-housing 226*a*. The lower part of the lower gear 245 is submerged in the oil within the sump 238'. The oil flung by the gear 245 lubricates the sliding bearings 223' and the oil seals 242'.

For the purpose of preventing a jolt in the thrust direction of the ball bearing 233, it has been proposed to use a double angular ball bearing, however the system has a mechanical loss and is noisy. The sliding bearings 223 and 223' in FIG. 5 support loads only in the radial direction. Additionally, the oil-supplied by flying is not always enough for the bearings 223 and 223'. Therefore it is possible that the bearings are damaged.

SUMMARY OF THE INVENTION

It is an object of the invention to provide a mechanical supercharger which can supply sufficient oil to the rotor shaft bearings.

It is another object of the invention to provide a mechanical supercharger which has a high efficiency.

It is yet another object of the invention to provide a mechanical supercharger which is not noisy.

The above, and other, objects are accomplished according to the present invention by a mechanical supercharger having housing means defining an enclosed volume, two parallel rotor shafts extending through the housing means, the shafts being rotationally and axially supported in the housing means, meshing rotors mounted on the rotor shafts such that a rotation of the rotor shafts with the rotors supercharges a gas in the enclosed volume, and means for rotationally and axially supporting the rotor shafts in the housing means. The means for rotationally and axially supporting the rotor shaft in the housing means comprises first sliding bearing means adjacent one axial end of the rotor shafts for rotationally and axially supporting the rotor shafts, second sliding bearing means adjacent another axial end of the rotor shafts for rotationally supporting the rotor shafts, and lubricating means for supplying lubricating oil to the first and second sliding bearing means.

According to a feature of the invention, the housing means includes a bearing housing and the first sliding bearing means is in the bearing housing and includes an inner part fixed to each of the shafts and having a cylindrical part and a radially extending, disc-like plate part. The first sliding bearing means further includes an outer part fixed to the housing means and having axial bores closely surrounding the cylindrical parts of the inner parts to rotationally support the cylindrical parts, whereby an axial face of the plate part closely faces the outer part. The first sliding bearing means further includes a retainer engaging the outer part and facing another axial face of the inner part, the retainer cooperating with the outer part to axially support the plate part.

According to a feature of the invention, the lubricating means can include oil passages in the bearing housing, in the outer part of the first sliding bearing means and in the retainer for supplying oil to spaces between the inner part and the outer part and retainer, whereby the first sliding bearing is lubricated.

According to yet a further feature of the invention, the lubricating means can comprise pump means in the form of spirals formed in the first bearing means for pumping lubricating oil from a gear chamber of the housing means to between the inner part and the outer part and retainer, whereby the first sliding bearing is lubricated. The pumped oil may then be delivered to spaces between the support means and the rotor shafts in the second bearing means and returned to the gear chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
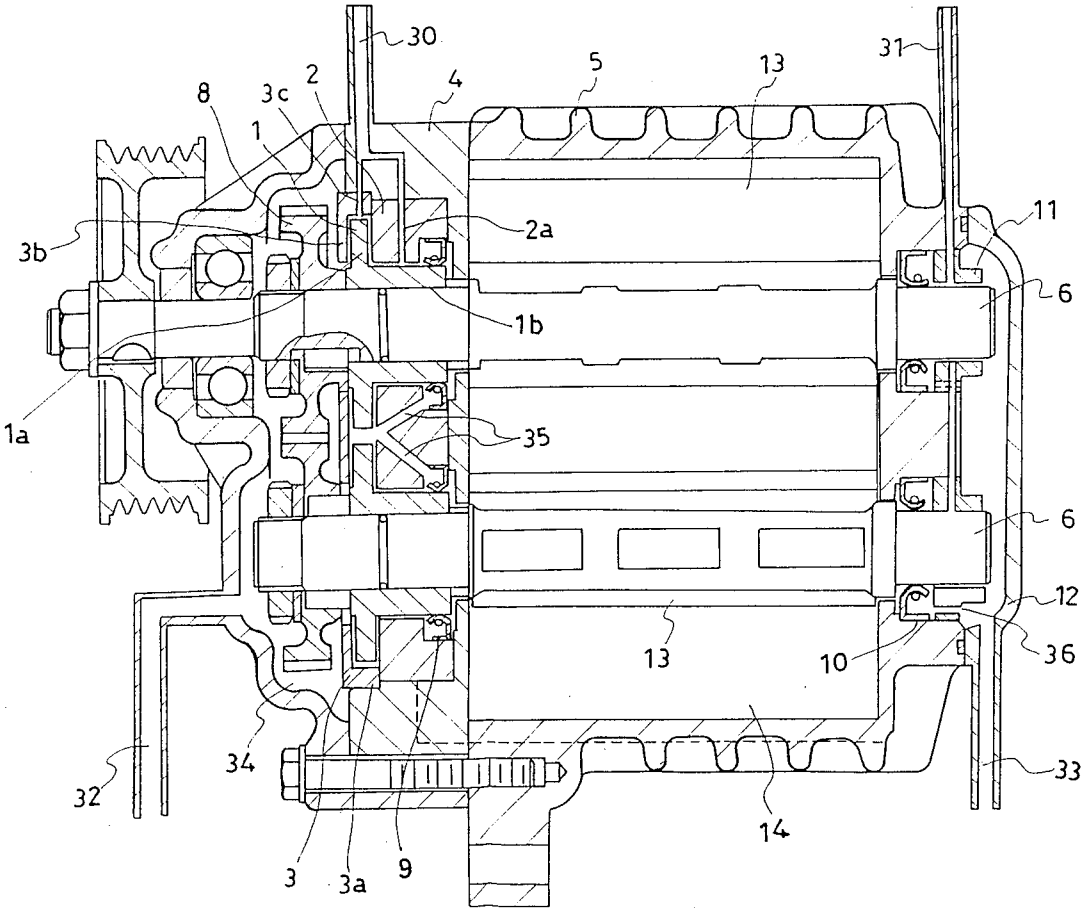
FIG. 1 is a cross-sectional view of an embodiment of the mechanical supercharger of the invention.
Figure 5:
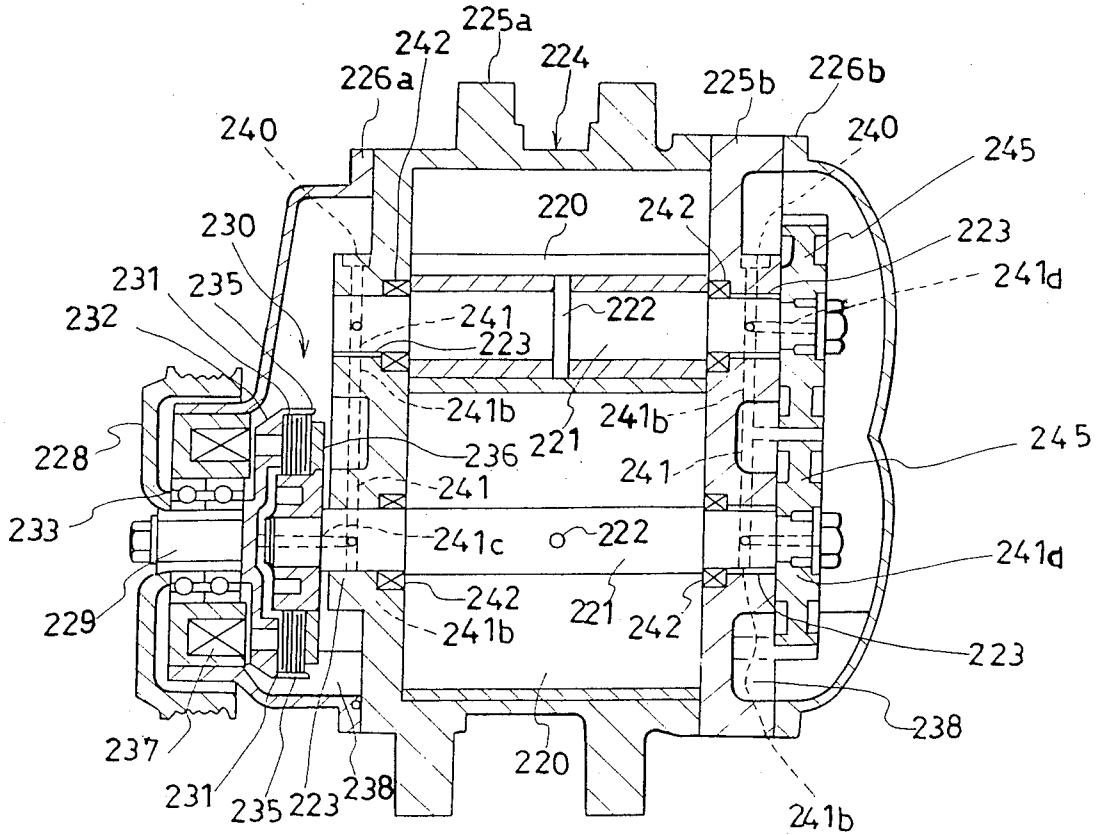
Fig 5 (Prior Art)
FIG. 5 is a cross-sectional view of a conventional mechanical supercharger.

In the embodiment of FIG. 1 the construction which consists of two rotors fixed to rotor shafts is the same as in the conventional mechanical supercharger in FIG. 5.

In FIG. 1 a mechanical supercharger has a first sliding bearing means consisting of an outer part 2, two inner parts 1 and a retainer 3. The outer part 2 is tightly inserted in a bearing-housing 4. Each of the inner parts 1 is fixed to a respective rotor shaft 6 or 6' carrying a respective rotor 13 or 13' so as to rotate therewith, and consists of a radially extending disc-like plate part 1*a* having an axial side facing an axial side of the outer part 2 and a cylindrical part 1*b* extending axially within a surrounding bore of the outer part 2 and fixed to the shaft 6 and 6'. The retainer 3 has an outer circumferential part 3*a* contacting an outer area of the axial side of the outer part 2 and an axial side face part 3*b* facing an axial side of the plate part 1*a*.

A second sliding bearing means consists of a support 11 as a supporting means and a circumferential face of the shaft 6 or 6'. The support 11 is tightly inserted in the rotor-housing 5 and directly supports the shafts 6 and 6'.

A lubricating oil for the first bearing means is supplied from a passage 30 formed in the bearing housing 4 to the spaces between the outer part 2, the inner part 1 and the retainer 3 via a passage 2*a* in the upper part of the outer part 2 and a passage 3*c* in the upper part of the retainer 3. The oil supplied from the passage 30 lubricates drive gears 8 after draining from the first bearing means. A drain-passage 32 is formed in the gear-chamber 34 so as to drain excess oil from the bearing housing 4. A lubricating oil for the second bearing means is supplied to the support means 11 through a passage 31 formed in the rotor housing 5. A drain-passage 33 is formed in the rear-cover 12 so as to drain excess oil.

For preventing air and oil leaks, seals 9, 10 are set in the first and second bearing means. Oil retained by the seals 9,10 is returned to the sump via the passage 35. Rotors 13 and 13' fixed on the shafts 6 and 6' are set in a rotor-chamber 14 defined by the rotor-housing 5 and the bearing-housing 4.

In the above-described construction, the lubricating oil is pumped by an oil pump in the internal combustion engine, and is supplied to the first and second bearing means via the passages 30 and 31. From passage 30, the oil flows in the spaces between the inner parts 1 and the outer part 2 and between the inner parts and the retainer 3. The oil from the passage 31 flows in the spaces between the support 11 and the shafts 6 and 6'. Therefore the metal parts rotate without directly contacting each other.

The axial thrust load is supported by the plate part 1*a* of the inner part 1 contacting the retainer 3 and the axial side face of the outer part 2. The radial loads are supported by the inner faces of the outer part 2 and the support 11. The lubricating oil which has flowed through the first bearing means is supplied to the sump in the gear-chamber 34 and returns to the internal combustion engine through the drain passage 32. In the second bearing means the lubricating oil flows through the bearing means, is supplied to the rear cover 12 and returns to the internal combustion engine through the drain passage 33. The lubricating oil retained by the oil seals 9 and 10 flows to the sump of the gear chamber 34 through the passage 35 in the outer part 2, and to the rear cover 12 through the passage 36 in the support 11.

Figure 2:
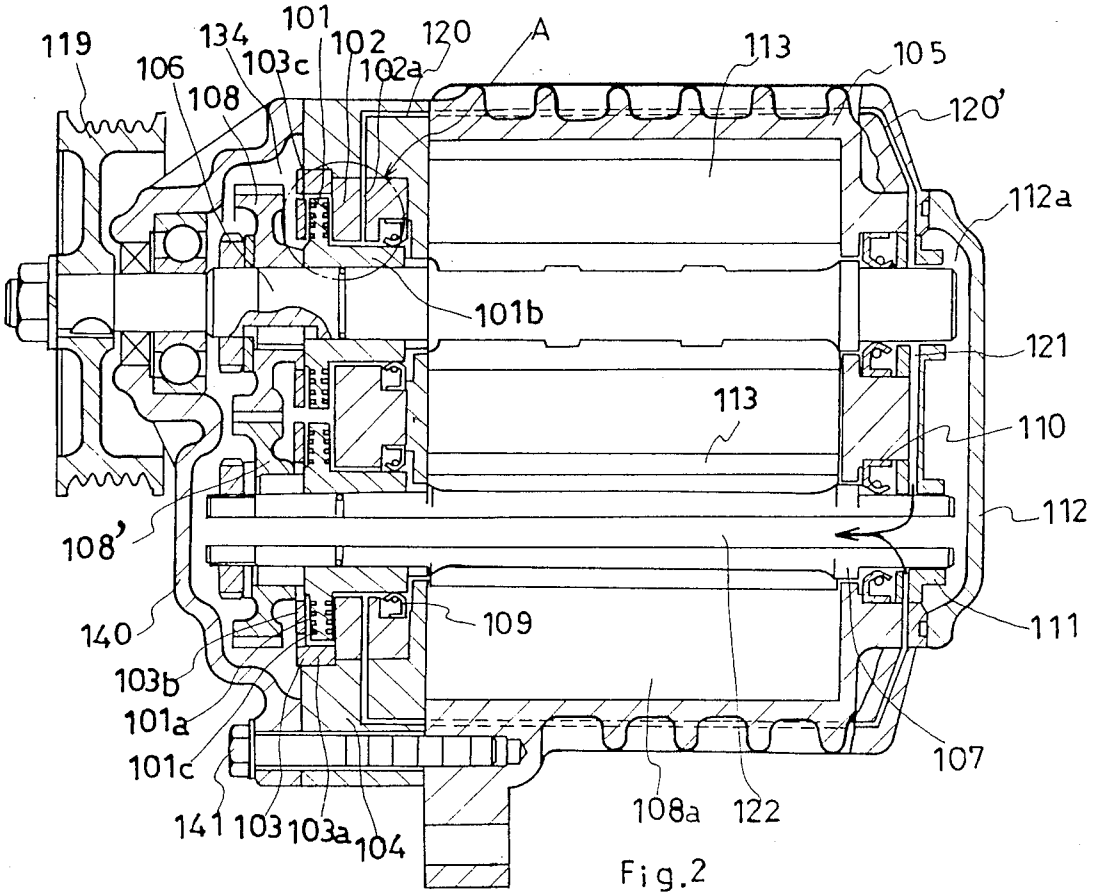
FIG. 2 is a cross-sectional view of another embodiment of the mechanical supercharger of the invention.
Figure 3:
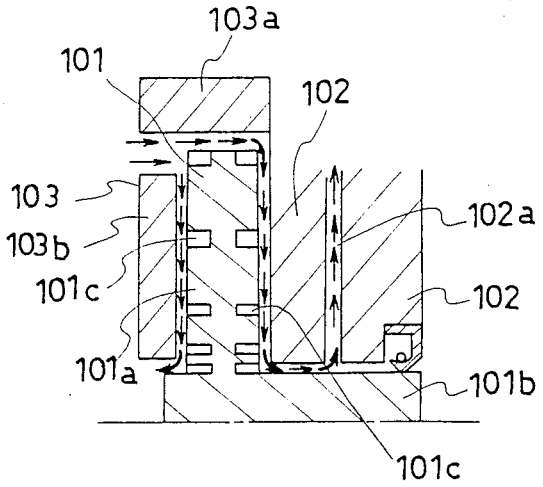
FIG. 3 is a view of detail A of FIG. 2.
Figure 4:
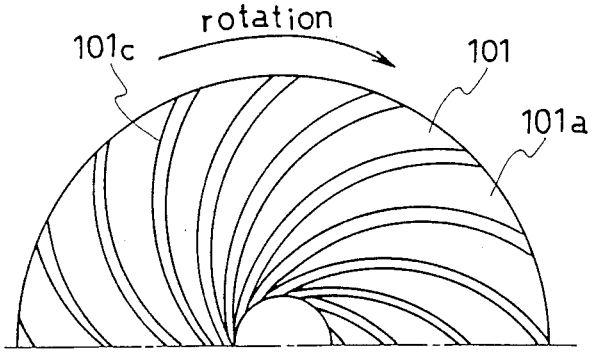
FIG. 4 is a front view of the plate part in FIG. 3.

In FIGS. 2 to 4 is shown another embodiment of the invention. The first sliding bearing means consists of an outer part 102, two inner parts 101 and a retainer 103. The second sliding bearing means consists of a support 111 and circumferential faces of the rotor shafts 106, 107 as is similar to the embodiment in FIG. 1. The outer part 102 is positioned around the cylindrical parts 101*b* of the inner parts 101, and holds the seals 109 for preventing oil leaks to the rotor chamber 108*a* via the inner parts, and has passages 102*a* for lubrication.

The passages 102 communicate with the passages 120, 120' formed in the bearing housing 104 and the rotor housing 105 in an oil circulation loop. The passages 120' communicate with the passage 121 in the support 111, and the passage 121 communicates with the recycle passage 122 which goes axially through the shaft 107. The passage 122 opens to the gear chamber 134 which is formed in the cover 140 fixed to the bearing housing 104 by the bolts 141 in the first bearing means side, and opens to the chamber 112*a* which is formed in the cover 112 fixed to the rotor-housing 105 by bolts (not shown in FIG. 2) in the second bearing means side.

On both sides of the plate part 101*a* are formed spiral grooves 101*c*, and when the plate part 101*a* rotates with the shaft 106, the spiral grooves function so as to pump oil from the gear chamber 134 to the passages 120, 120' via the passages 102*a*.

The retainer 103 has an outer circumferential part 103*a* contacting a part of the outer circumferential side of the outer part 102, a side face part 103*b* positioned to the outside of the plate part 101*a*, and a lubricating passage 103*c* communicated the gear chamber 134 with the plate part 101*a*. Gears 108, 108' are mounted on the shafts 106, 107 and engage with each other. A pulley 119 is mounted on the shaft 106 and transmits the driving force from the engine via a belt (not shown in the Figure).

In the above-mentioned construction, the mechanical supercharger functions as following. When the driving force from the engine drives the pulley 119 via the belt, the shaft 106 and the gear 108 rotate, and the gear 108' engaging with the gear 108 and the shaft 107 rotate in the reverse direction. The thrust loads operating on the shafts 106, 107 are supported by the plate part 101*a* and the retainer part 103*b* facing the side of the outer part 102. The radial loads are supported by the cylindrical part 101*b* of the inner part 101 and the outer part 102 on the first bearing means side, and by the support 111 supporting one end of each of the shafts 106, 107 on the second bearing means side.

Upon the rotation of the shafts 106, 107, the spiral grooves 101*c* on both sides of the plate parts 101*a* which rotate with the shafts 106, 107 pump lubricating oil from the gear chamber 134 through the gap between the inner part 101 and the outer part 102 to the passages 120, 120' via the passage 102*a*. Further, the oil flows to the passage 122 of the shaft 107 via the passage 121 of the support 111, and returns to the gear chamber 134. The oil lubricates the gears 108, 108' in the gear chamber 134, after which the oil again goes to the spiral grooves 101*c*.

As above mentioned, the invention supports the rotor in both the radial and thrust directions by the first and second bearing means. Therefore, interference between the ends of the rotors and the housing is prevented, and the clearance between the rotors and the housing can be minimized so that high efficiency is obtained. Further the oil is supplied directly to the bearing means through the passages; therefore the oil provides adequate lubrication, and mechanical losses and noise are reduced.

The spiral grooves function as a pump for the supplying the lubricating oil. Therefore a separate pump is not needed for the supercharger.

Obviously, numerous modifications and variations of the present invention are possible in light of the above teachings. It is therefore to be understood that within the scope of the appended claims, the invention may be practiced otherwise than as specifically described herein.

What is claimed is:

1. A mechanical supercharger comprising:

housing means defining an enclosed volume;

two parallel rotor shafts extending through said housing means, said shafts being rotationally and axially supported in said housing means;

meshing rotors mounted on said rotor shafts such that a rotation of said rotor shafts with said rotors supercharges a gas in the enclosed volume; and means for rotationally and axially supporting said rotor shafts in said housing means, comprising:

(a) first sliding bearing means adjacent one axial end of said rotor shafts for rotationally and axially supporting said rotor shafts, (b) second sliding bearing means adjacent another axial end of said rotor shafts for rotationally supporting said rotor shafts, and (c) lubricating means for supplying lubricating oil to said first and second sliding bearing means, wherein said housing means including a bearing housing and wherein said first sliding bearing means is in said bearing housing and comprises:

an inner part fixed to each of said shafts, each said inner part having a cylindrical part and a radially extending, disc-like plate part;

an outer part fixed to said housing means and having axial bores closely surrounding said cylindrical parts to rotationally support said cylindrical parts, wherein an axial face of said plate part closely faces said outer part; and a retainer engaging said outer part and enclosing another axial face of said inner part, said retainer cooperating with said outer part to axially support said plate part.

2. The supercharger of claim 1 wherein said second sliding bearing means comprises support means fixed in said housing means and having axial bores closely surrounding said rotor shafts for rotationally supporting said rotor shafts.

3. The supercharger of claim 2 wherein said lubricating means comprise oil passages in said bearing housing, in said outer part of said first sliding bearing means and in said retainer for supplying oil to spaces between said inner part and said outer part and retainer, whereby said first sliding bearing means is lubricated.

4. The supercharger of claim 3 including:

cover means attached to said housing means and defining a gear chamber into which lubricating oil from said first bearing means drains;

meshing gears in said gear chamber and mounted to said rotor shafts; and means for draining excess oil from said gear chamber.

5. The supercharger of claim 3 wherein said lubricating means further comprises additional oil passages in said housing means for supplying oil to spaces between the support means and said rotor shafts.

6. The supercharger of claim 2 wherein said lubricating means comprises pump means formed in said first bearing means for pumping lubricating oil from a gear chamber of said housing means to between said inner part and said outer part and retainer, whereby said first sliding bearing is lubricated.

7. The supercharger of claim 6 wherein said lubricating means further comprises oil passages in said outer part and said housing means for delivering oil pumped by said pump means from said spaces between inner part and said outer part to spaces between said support means and said rotor shafts.

8. The supercharger of claim 7 including an oil recycle passage in one of said rotor shafts for returning oil from said spaces between said support means and said rotor shafts to the gear chamber.

9. The supercharger of claim 6 wherein said pump means comprise spiral grooves on said plate part of each of said inner parts.

10. The supercharger of claim 8 wherein said pump means comprise spiral grooves on said plate part of each of said inner parts.

* * * * *

UNITED STATES PATENT AND TRADEMARK OFFICE

CERTIFICATE OF CORRECTION

PATENT NO. : 4,986,740

DATED : January 22, 1991

INVENTOR(S) : Kazunari Adachi

It is certified that error appears in the above-identified patent and that said Letters Patent is hereby corrected as shown below:

Title page: Item (73);

In the Assignee name, please delete "Alsin" and insert --Aisin--.

Signed and Sealed this

Eighteenth Day of August, 1992

*Attest:*

DOUGLAS B. COMER

*Attesting Officer*

*Acting Commissioner of Patents and Trademarks*